US010654697B2

(12) United States Patent
Houle

(10) Patent No.: US 10,654,697 B2
(45) Date of Patent: May 19, 2020

(54) GYROSCOPICALLY STABILIZED VEHICLE SYSTEM

(71) Applicant: Hand Held Products, Inc., Fort Mill, SC (US)

(72) Inventor: Scott Xavier Houle, Edmonds, WA (US)

(73) Assignee: Hand Held Products, Inc., Fort Mill, SC (US)

( * ) Notice: Subject to any disclaimer, the term of this patent is extended or adjusted under 35 U.S.C. 154(b) by 12 days.

(21) Appl. No.: 15/829,013

(22) Filed: Dec. 1, 2017

(65) Prior Publication Data

US 2019/0169008 A1 Jun. 6, 2019

(51) Int. Cl.
*B66F 9/075* (2006.01)
*B66F 17/00* (2006.01)

(52) U.S. Cl.
CPC ..... *B66F 9/07559* (2013.01); *B66F 9/0755* (2013.01); *B66F 17/003* (2013.01)

(58) Field of Classification Search
CPC ..... B66F 9/07559
See application file for complete search history.

(56) References Cited

U.S. PATENT DOCUMENTS 5,603,239 A 2/1997 Chong
6,832,725 B2 12/2004 Gardiner et al.
6,983,883 B2 * 1/2006 Ridling ..... G01G 19/083 177/136
7,128,266 B2 10/2006 Zhu et al.
7,159,783 B2 1/2007 Walczyk et al.
7,413,127 B2 8/2008 Ehrhart et al.
7,472,832 B2 * 1/2009 Lombardi, II ..... B66F 9/0755 235/383
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
(Continued)

FOREIGN PATENT DOCUMENTS

WO 2013163789 A1 11/2013

OTHER PUBLICATIONS

Adaptalift Blog, "Forklift Terminology Part 3: Stability & Maneuverability", Dated Dec. 12, 2010, 3 pages. {Downloaded on Dec. 1, 2017 from http://www.aalhysterforklifts.com.au/index.php/about/blog-post/forklift_terminology_part_3_stability_manoeuvrability}.

*Primary Examiner* — Michael J Zanelli
(74) *Attorney, Agent, or Firm* — Alston & Bird LLP

(57) ABSTRACT

A method of self-stabilizing a forklift having a volume dimensioning device, a weight sensor, and a gyroscopic disc when the forklift is lifting an object, comprises: determining dimensions and volume of the object with the volume dimensioning device; determining a weight of the object with the weight sensor; calculating an approximate center of gravity of the object; and stabilizing the forklift when lifting the object by rotating the gyroscopic disc at a rotational speed based on the determined weight and calculated approximate center of gravity of the object.

20 Claims, 6 Drawing Sheets

(56) References Cited

U.S. PATENT DOCUMENTS 8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.

(56) References Cited

U.S. PATENT DOCUMENTS 8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,061,527 B2 6/2015 Tobin et al.
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,076,459 B2 7/2015 Braho et al.
9,079,423 B2 7/2015 Bouverie et al.
9,080,856 B2 7/2015 Laffargue
9,082,023 B2 7/2015 Feng et al.
9,084,032 B2 7/2015 Rautiola et al.
9,087,250 B2 7/2015 Coyle
9,092,681 B2 7/2015 Havens et al.
9,092,682 B2 7/2015 Wilz et al.
9,092,683 B2 7/2015 Koziol et al.
9,093,141 B2 7/2015 Liu
D737,321 S 8/2015 Lee
9,098,763 B2 8/2015 Lu et al.
9,104,929 B2 8/2015 Todeschini
9,104,934 B2 8/2015 Li et al.
9,107,484 B2 8/2015 Chaney
9,111,159 B2 8/2015 Liu et al.
9,111,166 B2 8/2015 Cunningham
9,135,483 B2 9/2015 Liu et al.
9,137,009 B1 9/2015 Gardiner
9,141,839 B2 9/2015 Xian et al.
9,147,096 B2 9/2015 Wang
9,148,474 B2 9/2015 Skvoretz
9,158,000 B2 10/2015 Sauerwein
9,158,340 B2 10/2015 Reed et al.
9,158,953 B2 10/2015 Gillet et al.
9,159,059 B2 10/2015 Daddabbo et al.
9,165,174 B2 10/2015 Huck
9,171,543 B2 10/2015 Emerick et al.
9,183,425 B2 11/2015 Wang
9,189,669 B2 11/2015 Zhu et al.
9,195,844 B2 11/2015 Todeschini et al.
9,202,458 B2 12/2015 Braho et al.
9,208,366 B2 12/2015 Liu
9,208,367 B2 12/2015 Wang
9,219,836 B2 12/2015 Bouverie et al.
9,224,022 B2 12/2015 Ackley et al.
9,224,024 B2 12/2015 Bremer et al.
9,224,027 B2 12/2015 Van Horn et al.
D747,321 S 1/2016 London et al.
9,230,140 B1 1/2016 Ackley
9,235,553 B2 1/2016 Fitch et al.
9,239,950 B2 1/2016 Fletcher
9,245,492 B2 1/2016 Ackley et al.
9,443,123 B2 1/2016 Hejl
9,248,640 B2 2/2016 Heng
9,250,652 B2 2/2016 London et al.
9,250,712 B1 2/2016 Todeschini
9,251,411 B2 2/2016 Todeschini
9,258,033 B2 2/2016 Showering
9,262,633 B1 2/2016 Todeschini et al.
9,262,660 B2 2/2016 Lu et al.
9,262,662 B2 2/2016 Chen et al.
9,269,036 B2 2/2016 Bremer
9,270,782 B2 2/2016 Hala et al.
9,274,812 B2 3/2016 Doren et al.
9,275,388 B2 3/2016 Havens et al.
9,277,668 B2 3/2016 Feng et al.
9,280,693 B2 3/2016 Feng et al.
9,286,496 B2 3/2016 Smith
9,297,900 B2 3/2016 Jiang
9,298,964 B2 3/2016 Li et al.
9,301,427 B2 3/2016 Feng et al.
D754,205 S 4/2016 Nguyen et al.
D754,206 S 4/2016 Nguyen et al.
9,304,376 B2 4/2016 Anderson
9,310,609 B2 4/2016 Rueblinger et al.
9,313,377 B2 4/2016 Todeschini et al.
9,317,037 B2 4/2016 Byford et al.
9,319,548 B2 4/2016 Showering et al.
D757,009 S 5/2016 Oberpriller et al.
9,342,723 B2 5/2016 Liu et al.
9,342,724 B2 5/2016 McCloskey
9,361,882 B2 6/2016 Ressler et al.
9,365,381 B2 6/2016 Colonel et al.
9,373,018 B2 6/2016 Colavito et al.
9,375,945 B1 6/2016 Bowles
9,378,403 B2 6/2016 Wang et al.
D760,719 S 7/2016 Zhou et al.
9,360,304 B2 7/2016 Chang et al.
9,383,848 B2 7/2016 Daghigh
9,384,374 B2 7/2016 Bianconi
9,390,304 B2 7/2016 Chang et al.
9,390,596 B1 7/2016 Todeschini
D762,604 S 8/2016 Fitch et al.
9,411,386 B2 8/2016 Sauerwein
9,412,242 B2 8/2016 Van Horn et al.
9,418,269 B2 8/2016 Havens et al.
9,418,270 B2 8/2016 Van Volkinburg et al.
9,423,318 B2 8/2016 Lui et al.
D766,244 S 9/2016 Zhou et al.
9,443,222 B2 9/2016 Singel et al.
9,454,689 B2 9/2016 McCloskey et al.
9,464,885 B2 10/2016 Lloyd et al.
9,465,967 B2 10/2016 Xian et al.
9,478,113 B2 10/2016 Xie et al.
9,478,983 B2 10/2016 Kather et al.
D771,631 S 11/2016 Fitch et al.
9,481,186 B2 11/2016 Bouverie et al.
9,487,113 B2 11/2016 Schukalski
9,488,986 B1 11/2016 Solanki
9,489,782 B2 11/2016 Payne et al.
9,490,540 B1 11/2016 Davies et al.
9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.
9,530,038 B2 12/2016 Xian et al.
D777,166 S 1/2017 Bidwell et al.
9,558,386 B2 1/2017 Yeakley

(56) References Cited

U.S. PATENT DOCUMENTS 9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0101684 A1* 4/2012 Takazato ..... B66F 9/07568 701/41
2012/0111946 A1 5/2012 Golant
2012/0168512 A1 7/2012 Kotlarsky et al.
2012/0193423 A1 8/2012 Samek
2012/0194692 A1 8/2012 Mers et al.
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0124430 A1 6/2013 Moir et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2013/0332996 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0036848 A1 2/2014 Pease et al.
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0191684 A1 7/2014 Valois
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0332590 A1 11/2014 Wang et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0178523 A1 6/2015 Gelay et al.
2015/0178537 A1 6/2015 El et al.
2015/0178685 A1 6/2015 Krumel et al.

(56) References Cited

U.S. PATENT DOCUMENTS

2015/0181109 A1 6/2015 Gillet et al.
2015/0186703 A1 7/2015 Chen et al.
2015/0199957 A1 7/2015 Funyak et al.
2015/0210199 A1 7/2015 Payne
2015/0212565 A1 7/2015 Murawski et al.
2015/0213647 A1 7/2015 Laffargue et al.
2015/0220753 A1 8/2015 Zhu et al.
2015/0220901 A1 8/2015 Gomez et al.
2015/0227189 A1 8/2015 Davis et al.
2015/0236984 A1 8/2015 Sevier
2015/0239348 A1 8/2015 Chamberlin
2015/0242658 A1 8/2015 Nahill et al.
2015/0248572 A1 9/2015 Soule et al.
2015/0254485 A1 9/2015 Feng et al.
2015/0261643 A1 9/2015 Caballero et al.
2015/0264624 A1 9/2015 Wang et al.
2015/0268971 A1 9/2015 Barten
2015/0269402 A1 9/2015 Barber et al.
2015/0288689 A1 10/2015 Todeschini et al.
2015/0288896 A1 10/2015 Wang
2015/0310243 A1 10/2015 Ackley
2015/0310244 A1 10/2015 Kian et al.
2015/0310389 A1 10/2015 Crimm et al.
2015/0312780 A1 10/2015 Wang et al.
2015/0327012 A1 11/2015 Bian et al.
2016/0014251 A1 1/2016 Hejl
2016/0025697 A1 1/2016 Alt et al.
2016/0026838 A1 1/2016 Gillet et al.
2016/0026839 A1 1/2016 Du et al.
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschinie et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.

(56) References Cited

U.S. PATENT DOCUMENTS

| | | | | |
|---|---|---|---|---|
| 2017/0126904 | A1 | 5/2017 | d'Armancourt et al. | |
| 2017/0139012 | A1 | 5/2017 | Smith | |
| 2017/0140329 | A1 | 5/2017 | Bernhardt et al. | |
| 2017/0140731 | A1 | 5/2017 | Smith | |
| 2017/0147847 | A1 | 5/2017 | Berggren et al. | |
| 2017/0150124 | A1 | 5/2017 | Thuries | |
| 2017/0169198 | A1 | 6/2017 | Nichols | |
| 2017/0171035 | A1 | 6/2017 | Lu et al. | |
| 2017/0171703 | A1 | 6/2017 | Maheswaranathan | |
| 2017/0171803 | A1 | 6/2017 | Maheswaranathan | |
| 2017/0180359 | A1 | 6/2017 | Wolski et al. | |
| 2017/0180577 | A1 | 6/2017 | Nguon et al. | |
| 2017/0181299 | A1 | 6/2017 | Shi et al. | |
| 2017/0190192 | A1 | 7/2017 | Delario et al. | |
| 2017/0193432 | A1 | 7/2017 | Bernhardt | |
| 2017/0193461 | A1 | 7/2017 | Jonas et al. | |
| 2017/0193727 | A1 | 7/2017 | Van Horn et al. | |
| 2017/0199266 | A1 | 7/2017 | Rice et al. | |
| 2017/0200108 | A1 | 7/2017 | Au et al. | |
| 2017/0200275 | A1 | 7/2017 | McCloskey et al. | |
| 2017/0315014 | A1* | 11/2017 | Regan ..... | G01M 1/122 |

* cited by examiner

GYROSCOPICALLY STABILIZED VEHICLE SYSTEM

FIELD OF THE INVENTION

The invention is generally related to industrial vehicle stabilization systems, and, more specifically, to gyroscopically stabilized industrial vehicle systems.

BACKGROUND

Industrial vehicles, such as forklifts, are commonly used in warehouse and industrial settings to move and place objects. Often these objects are very heavy, necessitating conventional forklifts to be proportionally built to properly balance these heavy loads. As a general rule, the actual weight of a forklift (i.e. service weight) will be 1.5 to 2 times the lift capacity of the forklift. For example, if a forklift has a lifting capacity of 5,000 pounds, the service weight of the forklift will be somewhere between 7,500-10,000 pounds. This excessive weight helps the forklift, in combination with adjustable fulcrum points, to properly balance heavy loads without tipping over.

While the excessive weight helps properly balance heavy loads, the excessive weight comes at a cost of requiring large motors to operate the forklift. These large motors contribute to an increased service weight, and consume large quantities of energy to operate. Additionally, when lifting lighter loads, the forklift does not need all of the service weight in order to balance the load. However, the large motor will still consume large quantities of energy to move the unneeded weight.

If an industrial vehicle such as a forklift could be made lighter while maintaining the same lifting capacity as a conventional forklift, then the forklift could use a smaller motor, and the user could reduce operational costs.

SUMMARY

In an embodiment, a method of self-stabilizing a forklift having a volume dimensioning device, a weight sensor, and a gyroscopic disc when the forklift is lifting an object, comprises: determining dimensions and volume of the object with the volume dimensioning device; determining a weight of the object with the weight sensor; calculating an approximate center of gravity of the object; and stabilizing the forklift when lifting the object by rotating the gyroscopic disc at a rotational speed based on the determined weight and calculated approximate center of gravity of the object.

In an embodiment, the volume dimensioning device is a 3D range camera.

In an embodiment, the weight sensor is a barcode reader operable to read a barcode positioned on the object, the barcode encoding a weight of the object.

In another embodiment, the forklift comprises a plurality of gyroscopic discs.

In an embodiment, the method comprises rotating two or more gyroscopic discs when the forklift lifts the object, the rotational speed of the rotating gyroscopic discs being based on the approximate center of gravity and determined weight of the object.

In an embodiment, each gyroscopic disc has a different diameter and weight than the other gyroscopic discs.

In another embodiment, when a total stabilizing force generated by rotating all the plurality of gyroscopic discs exceeds a stabilizing force needed to stabilize the forklift when lifting the object, a first gyroscopic disc is rotated, and a second gyroscopic disc remains stationary.

In an embodiment, the forklift further comprises a processor in communication with the volume dimensioning device and weight sensor, the processor being operable to: receive the calculated volume and dimensions from the volume dimensioning device, and the determined weight from the weight sensor; perform the calculation of the approximate center of gravity of the object based on the calculated volume and dimensions and determined weight of the object; control a rotational speed of the gyroscopic disc; and responsive to the calculated approximate center of gravity and determined weight of the object, adjust the rotational speed of the gyroscopic disc.

In an embodiment, the volume dimensioning device is positioned on a mast of the forklift.

In another embodiment, the weight sensor is attached to a mast of the forklift and is configured to measure the weight of the object as the object is lifted by the forklift.

In yet another embodiment, a method of stabilizing a forklift, comprises: determining a weight of an object with a weight sensor; determining dimensions and volume of the object with a volume dimensioning device; calculating an approximate center of gravity of the object based on the determined dimensions and volume of the object; rotating a gyroscopic disc positioned in a disc receiving space of the forklift at a rotational speed sufficient to stabilize the forklift when lifting the object, the rotational speed of the gyroscopic disc being based on the approximate center of gravity and the determined weight of the object.

In an embodiment, the volume dimensioning device is a 3D range camera.

In another embodiment, the volume dimension device is attached to a mast of the forklift.

In another embodiment, the weight sensor is attached to a mast of the forklift and is configured to measure the weight of the object as the object is lifted by the forklift.

In an embodiment, the forklift comprises a processor in communication with the volume dimensioning device and weight sensor, the processor being configured to calculate the approximate center of gravity.

In an embodiment, the processor is in communication with a motor controlling a rotational speed of gyroscopic disc, and instructs the motor to adjust the rotational speed of the gyroscopic disc in response to the determined weight and approximate center of gravity of the object.

In another embodiment, the forklift comprises a plurality of gyroscopic discs.

In a further embodiment, each gyroscopic disc has a different diameter and weight than the other gyroscopic discs.

In an embodiment, when a total stabilizing force generated by rotating all the plurality of gyroscopic discs exceeds a stabilizing force needed to stabilize the forklift when lifting the object, a first gyroscopic disc is rotated, and a second gyroscopic disc remains stationary.

In another embodiment, the weight sensor is a barcode reader operable to read a barcode positioned on an object to be lifted, the barcode encoding a weight of the object.

BRIEF DESCRIPTION OF THE DRAWINGS

The invention will now be described by way of example with reference to the accompanying figures, of which.

DETAILED DESCRIPTION

Figure 1:
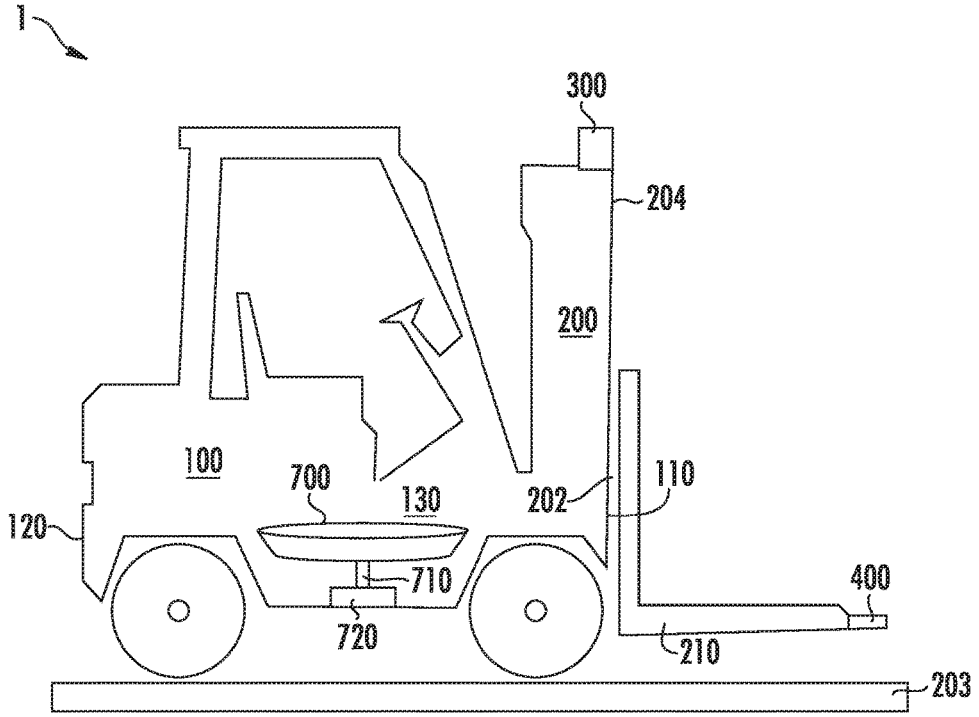
FIG. 1 is a side view of an industrial vehicle.

Embodiments of the invention will now be described with reference to FIGS. 1-9.

An industrial vehicle 1 has a body 100, a mast 200, a volume dimensioning device 300, a weight sensor 400, a computing device 500, and a gyroscopic disc 700.

In an embodiment, the industrial vehicle 1 is a forklift. In another embodiment, the industrial vehicle is a bucket crane vehicle, or any other type of industrial vehicle designed to lift and move objects 600.

In the embodiments of FIG. 1 the body 100 has a first end 110, an opposite second end 120, and a disc receiving space 130. The disc receiving space 130 is positioned between the first end 110 and the second end 120.

In an embodiment, the mast 200 is a vertical mast, as shown in FIG. 1. The mast 200 comprises a lower end 202 proximate to a support surface 203, and an opposite upper end 204 distal to the support surface. A set of forks 210 are operatively connected to the mast 200, and are vertically moveable along a length of the mast 200. The mast 200 is connected at the lower end 202 to the first end 110 of the body 100. The mast 200 can pivot at the lower end 202 to tilt away from the first end 110, or tilt towards the first end 110 in order to adjust a center of gravity of a load placed on the forks 210 by an object 600 being lifted.

In another embodiment, the mast 200 is a horizontal mast (not shown) on a telescopic forklift or boom lift. When the mast 200 is the horizontal mast, the set of forks 210 are operatively connected to a leading end of the horizontal mast, opposite a pivoting end of the mast connected to the second end 120 of the body 100.

Figure 2:
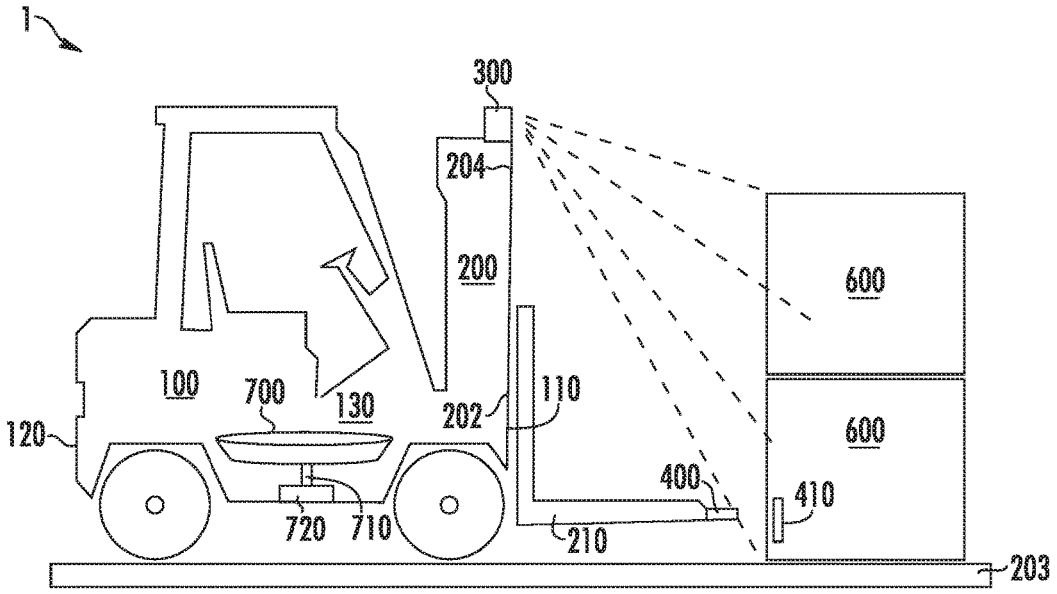
FIG. 2 is a side view of an industrial vehicle and a volume dimensioning device.
Figure 3:
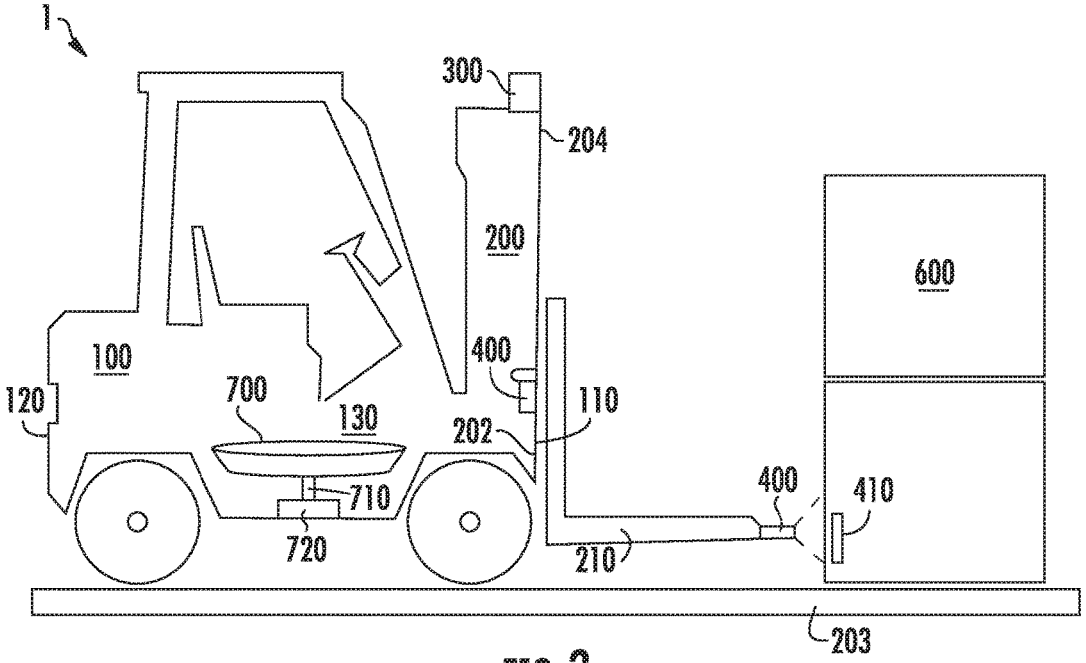
FIG. 3 is a side view of an industrial vehicle and a weight sensor.

The volume dimensioning device 300 measures the dimensions and calculates the volume of the object 600 to be lifted by the industrial vehicle 1. In an embodiment, the volume dimensioning device 300 is a 3D range camera. The 3D range camera can use any method of producing a 3D range image, including but not limited to stereo triangulation, structured light, time-of-flight, and interferometry. The volume dimensioning device 300 can be mounted on the body 100 of the industrial vehicle 1, or can be mounted on the mast 200. For example, as seen in FIGS. 1-3, the volume dimensioning device 300 can be mounted on the upper end 204 of the mast 200, allowing the volume dimensioning device 300 to have a tangential view of the object 600. This orientation permits the volume dimensioning device 300 to observe several planes of the object 600, allowing for a more accurate determination of the object's volume.

The weight sensor 400 measures the weight of an object 600 to be lifted by the industrial vehicle 1. In an embodiment, the weight sensor 400 is a barcode reader operable to read a barcode 410 positioned on the object 600, the barcode 410 encoding a weight of the object 600. In another embodiment, the barcode 410 encodes both a weight and a weight distribution of the object 600. For example, as shown in FIGS. 1-3, when the industrial vehicle 1 is a forklift, the barcode reader 400 can be attached to the forks 210, and can scan a barcode 410 on the object 600 as the industrial vehicle 1 is positioned to lift the object 600. In another example, the barcode reader 400 can be positioned on the first end 110 of the body 100. In yet another example, the barcode reader 400 can be positioned on the mast 200. When the industrial vehicle 1 is a boom lift, the barcode reader 400 can be positioned at a location on the boom or body 100 that will be proximate to the object 600 being lifted.

In embodiment, the weight sensor 400 can be an RFID reader operable to read an RFID tag 410 positioned on the object 600, the RFID tag 410 encoding a weight of the object 600. In another embodiment, the RFID tag 410 encodes both a weight and a weight distribution of the object 600. The RFID reader 400 can be positioned on the front end 110 of the body 100 of the industrial vehicle 1, and can read the RFID tag 410 positioned on the object 600 as the industrial vehicle 1 is positioned to lift the object 600. In another example, the RFID reader 400 can be positioned on the first end 110 of the body 100. In yet another example, the RFID reader 400 can be positioned on the mast 200. When the industrial vehicle 1 is a boom lift, the RFID reader 400 can be positioned at a location on the boom or body 100 that will be proximate to the object 600 being lifted.

Figure 4:
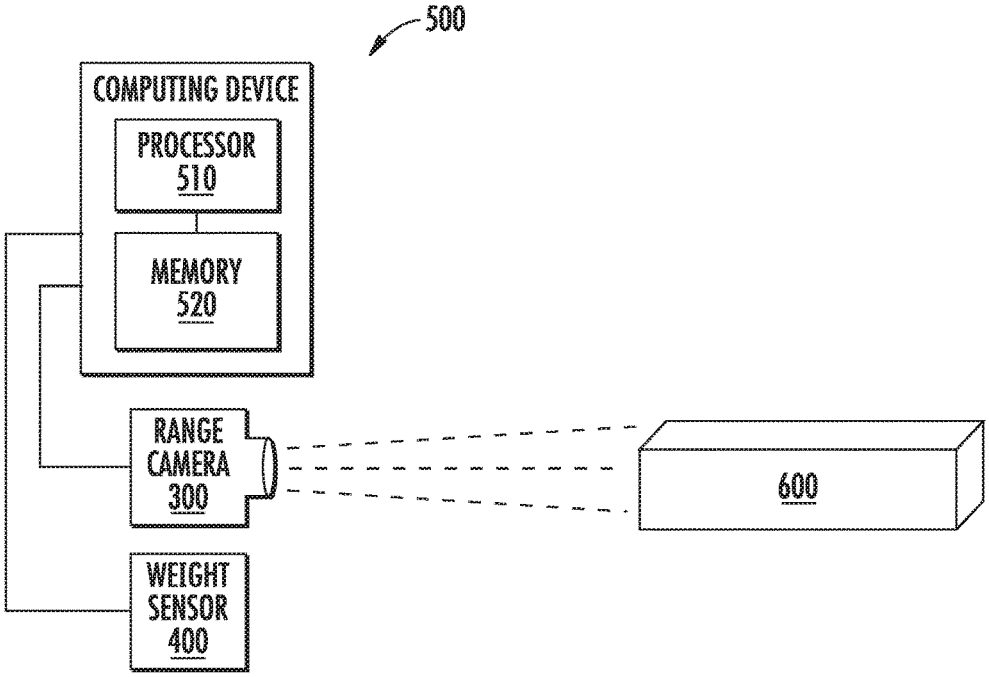
FIG. 4 is a schematic view of a computing device communicatively connected to a volume dimensioning device and a weight sensor.

The computing device 500 comprises a processor 510 and a memory 520, as shown in the exemplary embodiment of FIG. 4. Memory 520 can store executable instructions, such as, for example, computer readable instructions (e.g., software), that can be executed by processor 510.

The processor 510 is communicatively connected to the volume dimensioning device 300, and receives the dimensioning data and the calculated volume data of the object 600 from the volume dimensioning device 300. In an embodiment, the processor 510 receives dimensioning data directly from the volume dimensioning device 300, and the processor 510 calculates the volume of the object 600 from the dimensioning data.

The processor 510 is communicatively connected to the weight sensor 400, and receives the weight data of the object 600 from the weight sensor 400.

The processor 510 is configured to determine an approximate center of gravity of the object based on the volume, dimensions, and weight of the object 600. Additionally, the processor 510 is configured to determine the approximate center of gravity of the industrial vehicle 1 as the industrial vehicle 1 carries the object 600. For example, when the industrial vehicle 1 is a forklift, the approximate center of gravity will change as the forklift raises or lowers the object 600.

FIGS. 1-3 show a single gyroscopic disc 700 is positioned in the disc receiving space 130 located in the body 100. The gyroscopic disc 700 is mounted on a drive shaft 710 connected to a motor 720 (See FIGS. 5 and 6). The motor 720 can be electric, hydraulic, or any other type of motor commonly used in industrial vehicles, and is controlled by the processor 510. As shown in FIGS. 1-3, the motor 720 can be separate from a motor used to propel the industrial vehicle 1. In another embodiment (not shown), the motor 720 can be the same motor used to propel the industrial vehicle 1, with the rotational speed of the drive shaft 710 being controlled by a known clutch and transmission mechanism.

In another example embodied in FIGS. 1-3, a plurality of gyroscopic discs 700 are positioned in the disc receiving space 130. Each of the plurality of gyroscopic discs 700 can be equal in diameter, thickness, and/or weight, or each of the plurality of gyroscopic discs 700 can have different diameters, thicknesses, and/or weights. Each gyroscopic disc 700 can be mounted on the drive shaft 710 and spun by the motor 720. Further, each gyroscopic disc 700 can be disengaged from the drive shaft 710 such that only a few gyroscopic discs 700 are spun while the remainder of gyroscopic discs 700 remain at rest.

Figure 5:
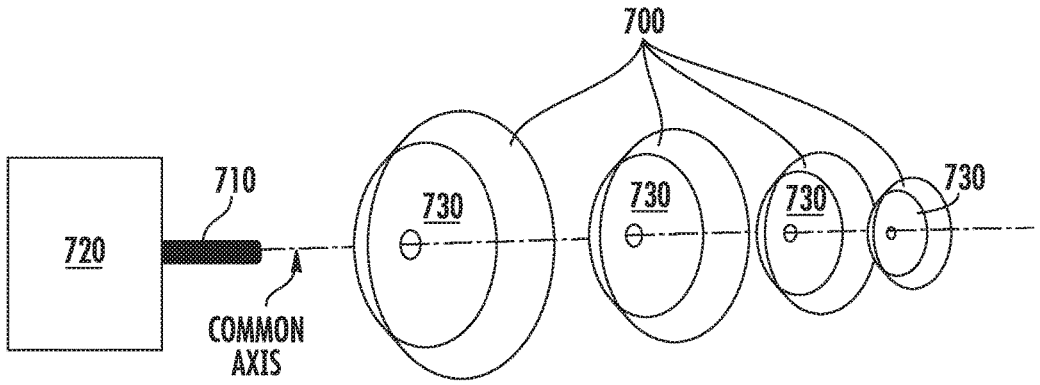
FIG. 5 is an exploded view of a plurality of gyroscopic discs.
Figure 6:
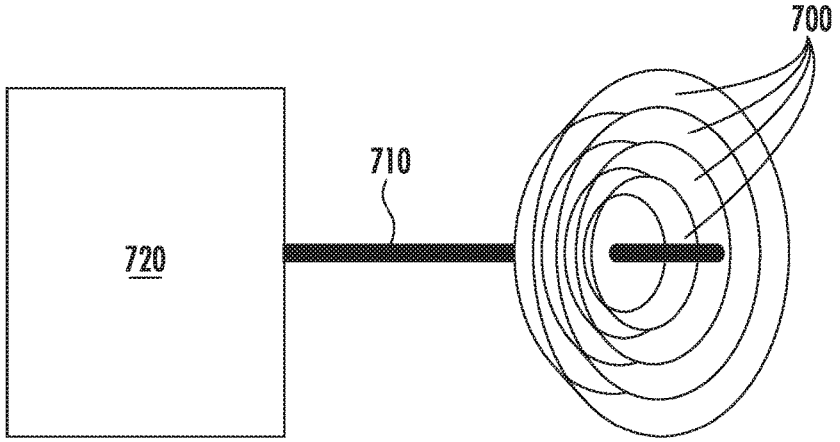
FIG. 6 is a perspective view of the plurality of gyroscopic discs stacked.

In an embodiment shown in FIGS. 5 and 6, when each of the gyroscopic discs 700 has a different diameter, each gyroscopic disc 700 can have a disc receiving recess 730 that has concentrically smaller or larger diameter than the disc receiving recesses 730 of the other gyroscopic discs 700. When the plurality of different diameter gyroscopic discs 700 are concentrically stacked on each other, each gyroscopic disc 700 is positioned within the disc receiving recess 730 of a larger diameter gyroscopic disc 700.

As shown in FIGS. 1-3, the drive shaft 710 is vertically positioned relative to the support surface 203, forming a vertical spin axis that spins the gyroscopic disc 700 in horizontal plane. In another embodiment (not shown), the drive shaft 710 is horizontally positioned relative to the support surface 203, forming a horizontal spin axis that spins the gyroscopic disc 700 in the vertical plane. In both embodiments, the gyroscopic disc 700 is restricted to rotating about the spin axis determined by the orientation of the drive shaft 710.

In practice, a precession force is generated by spinning the gyroscopic disc 700, and this precession force is used to stabilize the industrial vehicle 1 when carrying a load by simulating the effects of counterweights used in conventional industrial vehicles 1. A spinning gyroscopic disc 700 exerts torque, M, about its torque axis when the gyroscopic disc 700 precesses about its precession axis when a spin velocity is greater than a precession velocity. The effect of the torque, M, is that when the industrial vehicle 1 tilts from vertical, the torque, M, is applied by the spinning gyroscopic disc 700 to the body 100 of the industrial vehicle 1 such that a resulting gyroscopic moment will tend to resist the industrial vehicle 1 from tilting from vertical.

The torque, M, can be expressed by the following equation when the gyroscopic disc 700 is a solid disc with a symmetrical axis:

$$M=\tfrac{1}{2}I\Omega P$$

where, $I=mr^2$=inertia moment of the gyroscopic disc about the spin axis;

$\Omega$=precession velocity;

P=spin velocity of gyroscopic disc;

m=total mass of gyroscopic disc; and r=radius of gyroscopic disc.

As evidenced in the equation, every change in the diameter of the gyroscopic disc 700 has an exponential effect on the inertia moment, and ultimately on the torque M. Additionally, the spin velocity P of the gyroscopic disc 700 has a linear effect on the torque M.

Thus, the total stabilization effect of the gyroscopic disc 700 on the industrial vehicle 1 is determined by controlling the spin velocity, total mass, and radius of the gyroscopic disc 700. In the embodiment where only a single gyroscopic disc 700 is used, the total mass and radius of the gyroscopic disc 700 are set, so the stabilizing torque M is adjustable by controlling the spin velocity P of the gyroscopic disc 700.

When the gyroscopic disc 700 is hoop-like with a symmetrical axis (e.g. similar in form to a bike tire), the torque, M, can be expressed by the equation:

$$M=I\Omega P$$

where those of ordinary skill in the art would recognize that while the torque, M, produced may be different than the torque, M, produced by a solid disc with a symmetrical axis, the principle remains the same.

The processor 510 can be communicatively connected to the motor 720, and can control the speed of the motor 720, and hence the rotational speed of the drive shaft 710, and ultimately the spin velocity of the gyroscopic disc 700. When a clutch and transmission mechanism is used to turn the drive shaft 710, the processor 510 can also be communicatively connected to the clutch and transmission mechanism to control the rotational speed of the drive shaft 710, and ultimately the spin velocity P of the gyroscopic disc 700.

When a plurality of gyroscopic discs 700 are employed, the processor 510 controls how many of the gyroscopic discs 700 are rotated at the same time, which gyroscopic discs 700 are rotated, and the spin velocity P at which the gyroscopic discs 700 are rotated. For example, as described in more detail below, after the processor 510 has determined the weight and approximate center of gravity of the object 600, the processor 510 can then determine what combination of gyroscopic discs 700 will produce sufficient torque M to stabilize the industrial vehicle 1 while the industrial vehicle 1 picks up the object 600. The particular combination of gyroscopic discs 700 can be determined based on the spin velocity P, total mass m, and radius of the gyroscopic discs 700.

Figure 7:
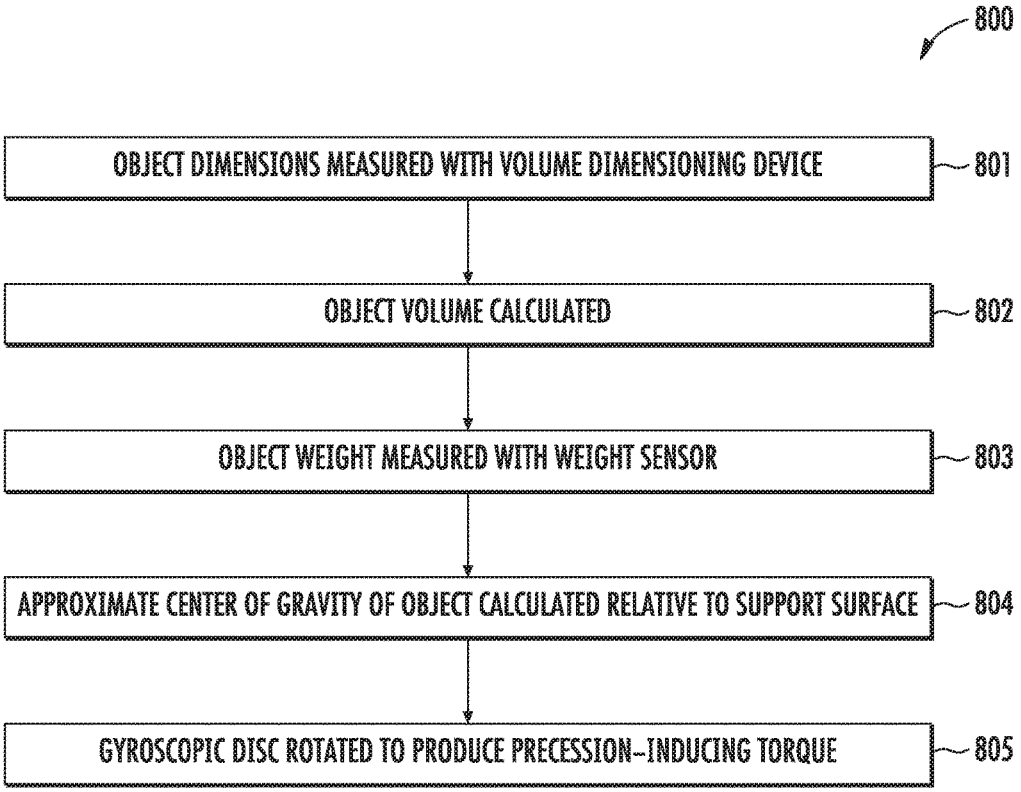
FIG. 7 is a block diagram of a method of gyroscopically stabilizing an industrial vehicle with a gyroscopic disc.

A method 800 of gyroscopically stabilizing an industrial vehicle 1 with a gyroscopic disc 700 will now be described with reference to FIG. 7. At block 801, dimensions of the object 600 are measured with the volume dimensioning device 300; a volume of the object 600 is calculated from the dimensions at block 802; at block 803 a weight of the object 800 is determined with the weight sensor 400; an approximate center of gravity of the object 600 is calculated from the dimensions, volume, and weight of the object relative to a support surface (e.g. the floor) at block 804; and the gyroscopic disc 700 is rotated at a spin velocity P that produces sufficient precession-inducing torque to stabilize the industrial vehicle 1 based on the determined weight and calculated approximate center of gravity of the object 600 at block 805.

Figure 8:
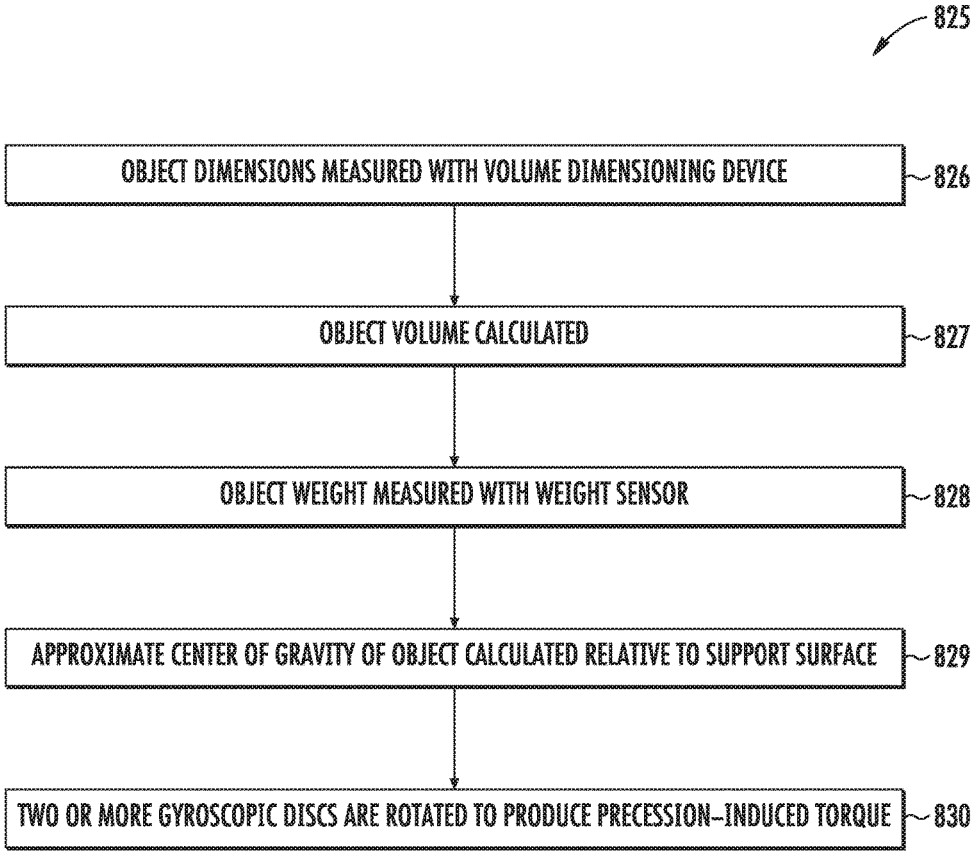
FIG. 8 is a block diagram of a method of gyroscopically stabilizing an industrial vehicle with a plurality of gyroscopic discs.

A method 825 of gyroscopically stabilizing an industrial vehicle 1 with a plurality of gyroscopic discs 700 is shown in FIG. 8. At block 826, dimensions of the object 600 are measured with the volume dimensioning device 300; a volume of the object 600 is calculated from the dimensions at block 827; at block 828 a weight of the object 800 is determined with the weight sensor 400; an approximate center of gravity of the object 600 is calculated from the dimensions, volume, and weight of the object relative to a support surface (e.g. the floor) at block 829; and two or more gyroscopic discs 700 are rotated at a spin velocity P that produces sufficient torque M to stabilize the industrial vehicle 1 based on the determined weight and calculated approximate center of gravity of the object 600, while one or more gyroscopic discs 700 remain stationary and are not rotated at block 830. In another embodiment, all of the gyroscopic discs 700 are rotated at a spin velocity P that produces sufficient torque M to stabilize the industrial vehicle 1 at block 830.

Figure 9:
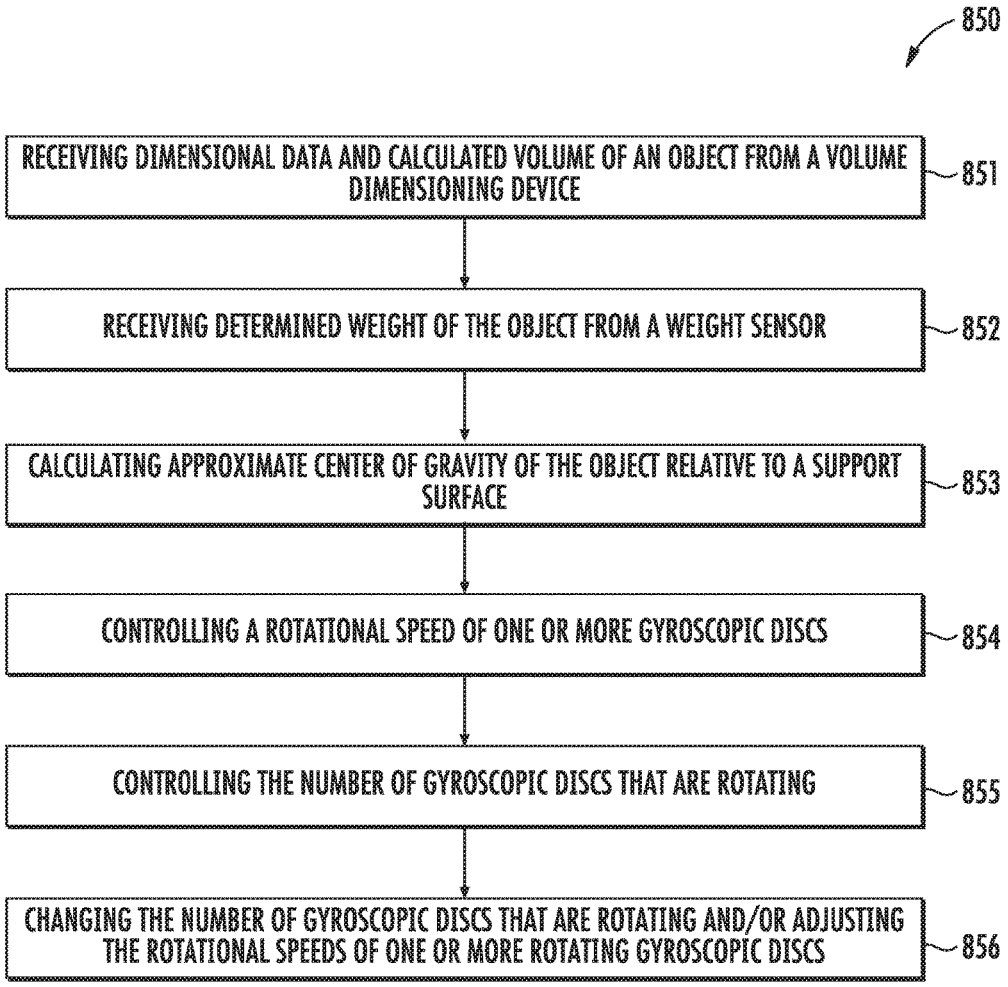
FIG. 9 is a block diagram of a method of controlling a gyroscopically stabilized industrial vehicle with a plurality of gyroscopic discs.

FIG. 9 discloses an embodiment of a method 850 of controlling a gyroscopically stabilized industrial vehicle 1 comprising a processor 510 being operable to: receive the dimensions and calculated volume of the object 600 from the volume dimensioning device 300 at block 851, and receive the determined weight of the object 600 from the weight sensor 400 at block 852; perform a calculation of the approximate center of gravity of the object 600 based on the dimensions, calculated volume and determined weight of the object 600 in relation to a support surface (e.g. the floor) at block 853; control a spin velocity P of one or more gyroscopic discs 700 at block 854; control the number of gyroscopic discs 700 that are rotating at block 855; and responsive to the calculated approximate center of gravity and determined weight of the object 600, change the number of gyroscopic discs 700 that are rotating and/or adjust the spin velocity P of the one or more rotating gyroscopic discs 700 at block 856.

In a further embodiment, the processor 510 is operable to control a spin velocity P of the gyroscopic disc 700 based on changes in the calculation of an approximate center of gravity of the object 600 relative to a support surface (e.g. the floor).

In another embodiment, when a plurality of gyroscopic discs 700 are used, the processor 510 activates or deactivates all or a portion of the gyroscopic discs 700 in response to the calculated approximate center of gravity and determined weight of the object 600. For example, when a torque M created by all of the plurality of gyroscopic discs 700 rotating exceeds a needed stabilizing force due to an object 600 that weighs less than the currently produced torque M, the processor 510 will only activate (e.g. rotate) enough of the gyroscopic discs 700 to sufficiently stabilize the industrial vehicle 1, the activation being determined by calculating an optimal torque Min view of the object 600 weight based on the spin velocity P, total mass m, and radius r of the gyroscopic discs 700 (discussed above). Additionally, the processor 510 will control the speed at which the gyroscopic discs 700 are rotated through communicative control over the motor 720. By only activating a subset of the gyroscopic discs 700 rather than all of the gyroscopic discs 700, the energy efficiency of the industrial vehicle 1 is improved.

Advantages of the described industrial vehicle include, but are not limited to a reduction in the weight of the industrial vehicle while maintaining the same lifting capacity as a conventional industrial vehicle using heavy counterweights. Additionally, the industrial vehicle can use a smaller motor than the convention industrial vehicle, since the overall weight of the industrial vehicle has been reduced, correspondingly reducing operational costs by requiring less fuel.

Further, the industrial vehicle will provide a more stable platform over uneven surfaces. For example, when a conventional industrial vehicle encounters an uneven surface, such as a dip or pothole, the conventional industrial vehicle's tires will follow the uneven surface into the dip, causing the conventional industrial vehicle to rock or shudder. When the conventional industrial vehicle is, for example, a forklift, this rocking motion can destabilize heavy loads, and can cause the heavy load to topple. However, when the industrial vehicle 1, encounters an uneven surface, the inertial torque generated by the gyroscopic disc will serve to stabilize the industrial vehicle by resisting the tendency of the industrial vehicle to rock or shudder. Instead, the industrial vehicle may "float" over the uneven surface, or the tires will more slowly enter into the uneven surface, reducing any sudden jarring motions.

To supplement the present disclosure, this application incorporates entirely by reference the following patents, patent application publications, and patent applications:

U.S. Pat. Nos. 6,832,725; 7,128,266; 7,159,783; 7,413,127; 7,726,575; 8,294,969; 8,317,105; 8,322,622; 8,366,005; 8,371,507; 8,376,233; 8,381,979; 8,390,909; 8,408,464; 8,408,468; 8,408,469; 8,424,768; 8,448,863; 8,457,013; 8,459,557; 8,469,272; 8,474,712; 8,479,992; 8,490,877; 8,517,271; 8,523,076; 8,528,818; 8,544,737; 8,548,242; 8,548,420; 8,550,335; 8,550,354; 8,550,357; 8,556,174; 8,556,176; 8,556,177; 8,559,767; 8,599,957; 8,561,895; 8,561,903; 8,561,905; 8,565,107; 8,571,307; 8,579,200; 8,583,924; 8,584,945; 8,587,595; 8,587,697; 8,588,869; 8,590,789; 8,596,539; 8,596,542; 8,596,543; 8,599,271; 8,599,957; 8,600,158; 8,600,167; 8,602,309; 8,608,053; 8,608,071; 8,611,309; 8,615,487; 8,616,454; 8,621,123; 8,622,303; 8,628,013; 8,628,015; 8,628,016; 8,629,926; 8,630,491; 8,635,309; 8,636,200; 8,636,212; 8,636,215; 8,636,224; 8,638,806; 8,640,958; 8,640,960; 8,643,717; 8,646,692; 8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630;

8,822,848; 8,824,692;
8,824,696; 8,842,849;
8,844,822; 8,844,823;
8,849,019; 8,851,383;
8,854,633; 8,866,963;
8,868,421; 8,868,519;
8,868,802; 8,868,803;
8,870,074; 8,879,639;
8,880,426; 8,881,983;
8,881,987; 8,903,172;
8,908,995; 8,910,870;
8,910,875; 8,914,290;
8,914,788; 8,915,439;
8,915,444; 8,916,789;
8,918,250; 8,918,564;
8,925,818; 8,939,374;
8,942,480; 8,944,313;
8,944,327; 8,944,332;
8,950,678; 8,967,468;
8,971,346; 8,976,030;
8,976,368; 8,978,981;
8,978,983; 8,978,984;
8,985,456; 8,985,457;
8,985,459; 8,985,461;
8,988,578; 8,988,590;
8,991,704; 8,996,194;
8,996,384; 9,002,641;
9,007,368; 9,010,641;
9,015,513; 9,016,576;
9,022,288; 9,030,964;
9,033,240; 9,033,242;
9,036,054; 9,037,344;
9,038,911; 9,038,915;
9,047,098; 9,047,359;
9,047,420; 9,047,525;
9,047,531; 9,053,055;
9,053,378; 9,053,380;
9,058,526; 9,064,165;
9,064,165; 9,064,167;
9,064,168; 9,064,254;
9,066,032; 9,070,032;
9,076,459; 9,079,423;
9,080,856; 9,082,023;
9,082,031; 9,084,032;
9,087,250; 9,092,681;
9,092,682; 9,092,683;
9,093,141; 9,098,763;
9,104,929; 9,104,934;
9,107,484; 9,111,159;
9,111,166; 9,135,483;
9,137,009; 9,141,839;
9,147,096; 9,148,474;
9,158,000; 9,158,340;
9,158,953; 9,159,059;
9,165,174; 9,171,543;
9,183,425; 9,189,669;
9,195,844; 9,202,458;
9,208,366; 9,208,367;
9,219,836; 9,224,024;
9,224,027; 9,230,140;
9,235,553; 9,239,950;
9,245,492; 9,248,640;
9,250,652; 9,250,712;
9,251,411; 9,258,033;
9,262,633; 9,262,660;
9,262,662; 9,269,036;
9,270,782; 9,274,812;
9,275,388; 9,277,668;
9,280,693; 9,286,496;
9,298,964; 9,301,427;
9,313,377; 9,317,037;
9,319,548; 9,342,723;
9,361,882; 9,365,381;
9,373,018; 9,375,945;
9,378,403; 9,383,848;
9,384,374; 9,390,304;
9,390,596; 9,411,386;
9,412,242; 9,418,269;
9,418,270; 9,465,967;
9,423,318; 9,424,454;
9,436,860; 9,443,123;
9,443,222; 9,454,689;
9,464,885; 9,465,967;
9,478,983; 9,481,186;
9,487,113; 9,488,986;
9,489,782; 9,490,540;
9,491,729; 9,497,092;
9,507,974; 9,519,814;
9,521,331; 9,530,038;
9,572,901; 9,558,386;
9,606,581; 9,646,189;
9,646,191; 9,652,648;
9,652,653; 9,656,487;
9,659,198; 9,680,282;
9,697,401; 9,701,140;
U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;

U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;

U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;

U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108;
U.S. Patent Application Publication No. 2017/0200275;

* * *

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

What is claimed is:

1. A method to stabilize a forklift carrying a load, the method comprising:

determining, by a volume dimensioning device, a dimension of the load and a volume of the load;

determining, by a weight sensor, a weight of the load;

calculating an approximate center of gravity of the load based on the determined dimension and volume of the load; and stabilizing the forklift when lifting the load by rotating the gyroscopic disc at a rotational speed determined based on the determined weight and calculated approximate center of gravity of the load.

2. The method of stabilizing the forklift of claim 1, wherein the volume dimensioning device is a 3D range camera.

3. The method of stabilizing the forklift of claim 1, wherein the weight sensor is a barcode reader operable to read a barcode positioned on the load, the barcode comprising information indicative of a weight of the load.

4. The method of stabilizing the forklift of claim 1, wherein the forklift comprises a plurality of gyroscopic discs.

5. The method of stabilizing the forklift of claim 4, the method further comprising:

rotating two or more gyroscopic discs in response to the forklift lifting the load, wherein rotational speeds of the rotating gyroscopic discs are based on the approximate center of gravity and determined weight of the load.

6. The method of stabilizing the forklift of claim 5, wherein each gyroscopic disc of the two or more gyroscopic discs has a different diameter and weight than the other gyroscopic discs.

7. The method of stabilizing a forklift of claim 4, wherein when a total stabilizing force generated by rotating all the plurality of gyroscopic discs exceeds a stabilizing force needed to stabilize the forklift when lifting the load, a first gyroscopic disc is rotated, and a second gyroscopic disc remains stationary.

8. The method of stabilizing the forklift of claim 1, wherein the forklift further comprises a processor in communication with the volume dimensioning device and weight sensor, the processor being operable to:

receive the determined volume and dimensions from the volume dimensioning device, and the determined weight from the weight sensor;

perform the calculation of the approximate center of gravity of the object based on the calculated volume and dimensions and determined weight of the object;

control a rotational speed of the gyroscopic disc; and responsive to the calculated approximate center of gravity and determined weight of the object, adjust the rotational speed of the gyroscopic disc.

9. The method of stabilizing the forklift of claim 1, wherein the volume dimensioning device is positioned on a mast of the forklift.

10. The method of stabilizing a forklift of claim 1, wherein the weight sensor is attached to a mast of the forklift and is configured to measure the weight of the object as the object is lifted by the forklift.

11. A method to stabilize a forklift, the method comprising:

determining, by a weight sensor, a weight of an object;

determining, by a volume dimensioning device, a dimension of the object and a volume of the object;

calculating an approximate center of gravity of the object based on the determined dimensions and volume of the object;

rotating a gyroscopic disc positioned in a disc receiving space of the forklift, at a rotational speed sufficient to stabilize the forklift when lifting the object, the rotational speed of the gyroscopic disc determined based on the calculated approximate center of gravity and the determined weight of the object.

12. The method of stabilizing a forklift of claim 11, wherein the volume dimensioning device is a 3D range camera.

13. The method of stabilizing a forklift of claim 11, wherein the volume dimensioning device is attached to a mast of the forklift.

14. The method of stabilizing a forklift of claim 11, wherein the weight sensor is attached to a mast of the forklift and is configured to measure the weight of the object as the object is lifted by the forklift.

15. The method of stabilizing a forklift of claim 11, wherein the forklift comprises a processor in communication with the volume dimensioning device and the weight sensor, the processor being configured to calculate the approximate center of gravity of the object.

16. The method of stabilizing a forklift of claim 15, wherein the processor is in communication with a motor controlling a rotational speed of the gyroscopic disc, and instructs the motor to adjust the rotational speed of the gyroscopic disc in response to the determined weight and calculated approximate center of gravity of the object.

17. The method of stabilizing a forklift of claim 11, wherein the forklift comprises a plurality of gyroscopic discs.

18. The method of stabilizing a forklift of claim 17, wherein each gyroscopic disc of the plurality of gyroscopic discs has a different diameter and weight than the other gyroscopic discs.

19. The method of stabilizing a forklift of claim 17, wherein in response to a total stabilizing force generated by rotating each gyroscopic disc of the plurality of gyroscopic discs exceeding a stabilizing force needed to stabilize the forklift when lifting the object, a first gyroscopic disc is rotated, and a second gyroscopic disc remains stationary.

20. The method of stabilizing a forklift of claim 11, wherein the weight sensor is a barcode reader operable to read a barcode positioned on an object to be lifted, the barcode comprising information indicative of a weight of the object.

* * * * *